US008715047B2

(12) United States Patent
Kim

(10) Patent No.: US 8,715,047 B2
(45) Date of Patent: May 6, 2014

(54) CEILING-MOUNTED AIR CONDITIONER

(75) Inventor: Young Joong Kim, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 284 days.

(21) Appl. No.: 13/142,574

(22) PCT Filed: Dec. 29, 2009

(86) PCT No.: PCT/KR2009/007850
§ 371 (c)(1),
(2), (4) Date: Oct. 3, 2011

(87) PCT Pub. No.: WO2010/077047
PCT Pub. Date: Jul. 8, 2010

(65) Prior Publication Data

US 2012/0034862 A1 Feb. 9, 2012

(30) Foreign Application Priority Data

Dec. 29, 2008 (KR) ..... 10-2008-0135760

(51) Int. Cl.
*F24F 7/00* (2006.01)
*F24F 13/00* (2006.01)

(52) U.S. Cl.
USPC ..... 454/254; 454/248; 454/292; 62/262

(58) Field of Classification Search
USPC ..... 454/233, 244, 248, 254, 292, 313; 62/132, 262
See application file for complete search history.

(56) References Cited

U.S. PATENT DOCUMENTS 2,782,612 A * 2/1957 Spiegelhalter ..... 62/162
4,327,989 A * 5/1982 Hope et al. ..... 396/622

(Continued)

FOREIGN PATENT DOCUMENTS

JP 2000-009330 1/2000
JP 2007100980 A * 4/2007

(Continued)

*Primary Examiner* — Steven B McAllister
*Assistant Examiner* — Jonathan Cotov
(74) *Attorney, Agent, or Firm* — McKenna Long & Aldridge LLP

(57) ABSTRACT

A ceiling-mounted air conditioner is provided. The ceiling-mounted air conditioner includes a main body which is fixed onto a ceiling of a room where the ceiling-mounted air conditioner is installed and includes an air intake formed at the bottom thereof; a door panel which is connected to the bottom of the main body so as to be able to be attached to or detached from the main body and shuts or opens the air intake by being lifted up or down; a plurality of moving elements which are fixed onto the top surface of the door panel, are a predetermined distance apart from one another, and are lifted up or down so as to be able to lift up or down the door panel; and a plurality of rotation elements which are disposed at the main body so as to be able to rotate and thus to lift up or down the moving elements, wherein each of the moving elements includes a vertical portion having a cavity portion extending vertically therein and protruding vertically from the top surface of the door panel, a driving force transmitting portion formed on one side of the cavity portion and contacting a corresponding rotation element, and an elevation guide portion formed on the other side of the cavity portion and guiding the elevation of the vertical portion. Therefore, it is possible to improve the exterior appearance of the ceiling-mounted air conditioner.

11 Claims, 10 Drawing Sheets

(56) References Cited

U.S. PATENT DOCUMENTS

| | | | | |
|---|---|---|---|---|
| 4,397,223 | A * | 8/1983 | Maxson | 454/255 |
| 5,167,577 | A * | 12/1992 | Kristensson | 454/298 |
| 5,461,875 | A * | 10/1995 | Lee et al. | 62/89 |
| 5,556,335 | A * | 9/1996 | Holyoake | 454/258 |
| 5,577,958 | A * | 11/1996 | Kumekawa et al. | 454/233 |
| 5,807,170 | A * | 9/1998 | Lee | 454/233 |
| 5,810,658 | A * | 9/1998 | Seo | 454/233 |
| 5,857,343 | A * | 1/1999 | Cho et al. | 62/89 |
| 5,888,133 | A * | 3/1999 | Mori et al. | 454/318 |
| 5,946,857 | A * | 9/1999 | Davies et al. | 49/260 |
| 6,089,972 | A * | 7/2000 | Gunji et al. | 454/233 |
| 6,264,552 | B1 * | 7/2001 | Oya et al. | 454/304 |
| 6,450,880 | B1 * | 9/2002 | Asahina et al. | 454/233 |
| 6,739,969 | B2 * | 5/2004 | Shin | 454/155 |
| 6,802,361 | B2 * | 10/2004 | Hatanaka | 165/53 |
| 6,868,693 | B2 * | 3/2005 | Choi et al. | 62/411 |
| 6,925,831 | B2 * | 8/2005 | Park et al. | 62/262 |
| 6,945,866 | B2 * | 9/2005 | Demster | 454/248 |
| 7,185,504 | B2 * | 3/2007 | Kasai et al. | 62/186 |
| 7,530,189 | B2 * | 5/2009 | Kim et al. | 40/725 |
| 8,230,693 | B2 * | 7/2012 | Tsuji et al. | 62/262 |
| 8,387,404 | B2 * | 3/2013 | Choi et al. | 62/132 |
| 2002/0177400 | A1 * | 11/2002 | Asahina et al. | 454/233 |
| 2005/0079740 | A1 * | 4/2005 | Nojima et al. | 439/34 |
| 2005/0287943 | A1 * | 12/2005 | Tokunaga et al. | 454/143 |
| 2006/0057953 | A1 * | 3/2006 | Natsume et al. | 454/161 |
| 2006/0168862 | A1 | 8/2006 | Kim et al. | |
| 2006/0218957 | A1 * | 10/2006 | Nakamura | 62/298 |
| 2007/0111651 | A1 * | 5/2007 | Sekito et al. | 454/121 |

FOREIGN PATENT DOCUMENTS

| | | | |
|---|---|---|---|
| JP | 2008-209099 | | 9/2008 |
| JP | 2008-261519 | | 10/2008 |
| KR | 10-0156706 | | 1/1999 |
| KR | 10-2006-0081998 | A | 7/2006 |
| KR | 10-2006-0095636 | A | 9/2006 |
| KR | 2006-0095636 | | 9/2006 |
| KR | 10-0691894 | | 3/2007 |

* cited by examiner (a)

(b)

(a)

(b)

CEILING-MOUNTED AIR CONDITIONER

This Application is a 35 U.S.C. §371 National Stage Entry of International Application No: PCT/KR2009/007850, filed on Dec. 29, 2009, which claims priority to Korean Patent Application No: 10-2008-0135760, filed on Dec. 29, 2008, both of which are hereby incorporated by reference in their entireties for all purposes as if fully set forth herein.

TECHNICAL FIELD

The present invention relates to a ceiling-mounted air conditioner, and more particularly, to a ceiling-mounted air conditioner which opens an air intake, through which indoor air can be drawn into a main body between a ceiling and a ceiling finishing material, only when it operates and can thus have an improved exterior appearance.

BACKGROUND ART

In general, ceiling-mounted air conditioners are devices for controlling indoor temperature by discharging heat-exchanged air into a room and can be installed at the ceiling of a room.

Ceiling-mounted air conditioners perform various functions not only including an air-conditioning function but also including an air-circulating function and an air-filtering function.

Ceiling-mounted air conditioners can filter out impurities included in indoor air while drawing the indoor air, exchanging heat with the indoor air and discharging the heat-exchanged air. For this, ceiling-mounted air conditioners generally include an air intake and an air outlet.

However, the air intakes of conventional ceiling-mounted air conditioners are always open even when the ceiling-mounted air conditioners do not operate, or are generally formed in a grill shape for filtering out large-size impurities, thereby degrading the exterior appearance of the ceiling-mounted air conditioners.

DISCLOSURE

Technical Problem

The present invention provides a ceiling-mounted air conditioner which opens or shuts an air intake, through which indoor air can be drawn into a main body, o by lifting up or down a door panel, which forms the bottom exterior, and can thus have an improved exterior appearance.

The present invention also provides a ceiling-mounted air conditioner, in which a door panel can be easily attached to or detached from an intake panel by providing stoppers at moving elements for lifting up or down the door panel.

Technical Solution

According to an aspect of the present invention, there is provided a ceiling-mounted air conditioner including a main body which is fixed onto a ceiling of a room where the ceiling-mounted air conditioner is installed and includes an air intake formed at the bottom thereof; a door panel which is connected to the bottom of the main body so as to be able to be attached to or detached from the main body and shuts or opens the air intake by being lifted up or down; a plurality of moving elements which are fixed onto the top surface of the door panel, are a predetermined distance apart from one another, and are lifted up or down so as to be able to lift up or down the door panel; and a plurality of rotation elements which are disposed at the main body so as to be able to rotate and thus to lift up or down the moving elements, wherein each of the moving elements includes a vertical portion having a cavity portion extending vertically therein and protruding vertically from the top surface of the door panel, a driving force transmitting portion formed on one side of the cavity portion and contacting a corresponding rotation element, and an elevation guide portion formed on the other side of the cavity portion and guiding the elevation of the vertical portion.

Each of the rotation elements may include a pinion gear fixed to the main body and the driving force transmitting portion may include a rack gear engaging with the pinion gear.

The elevation guide portion may be formed by forming a vertical cutout on the other side of the cavity portion so that part of the corresponding rotation element can be inserted into the vertical cutout.

The vertical portion may have a curved lateral surface.

Each of the moving elements may also include a rotation element entrance/exit portion, which is formed horizontally so that the corresponding rotation element can be inserted thereinto and placed in contact with the driving force transmitting portion.

The ceiling-mounted air conditioner may also include a plurality of stoppers attached to or detached from their respective moving elements, limiting a downward movement of the door panel and preventing the door panel from being accidentally detached from the main body.

The intake panel may include a plurality of elevation guide holes formed at regular intervals and the moving elements may be lifted up or down through the elevation guide holes.

The stoppers may be attached to or detached from upper parts of the moving elements that protrude beyond the elevation guide holes.

Each of the moving elements may also include a pair of rib portions formed at the upper part thereof, and each of the stoppers can be slidably inserted between the rib portions, and may include a pair of attachment/detachment portions horizontally inserted slidably into the rib portions and a latch portion which engages with the top surface of the intake panel.

The latch portion may extend horizontally from the attachment/detachment portions so as to be able to stop a corresponding moving element at the top surface of the intake panel.

The intake panel may also include a holding portion which is formed with a step difference around each of the elevation guide holes and can safely hold the bottom of the latch portion thereon.

The stoppers may have a greater size than the elevation guide holes so as to be able to shut the elevation guide holes and to be safely held by the holding portion.

Advantageous Effects

According to the present invention, an air intake, through which indoor air can be drawn into a main body of a ceiling-mounted air conditioner between a ceiling and a ceiling finishing material, is open when the ceiling-mounted air conditioner operates and is shut when the ceiling-mounted air conditioner does not operate. Therefore, it is possible to improve the exterior appearance of the ceiling-mounted air conditioner.

In addition, since an intake panel having the air intake can rotate along with a door panel, which is coupled to the bottom of the main body and includes a plurality of air outlets, and can thus open the inside of the main body, it is possible to facilitate the repair of the ceiling-mounted air conditioner. Moreover, since the door panel can be vertically attached to or detached from the air intake panel, it is possible to facilitate the replacement of the door panel.

BEST MODE

The present invention will hereinafter be described more fully with reference to the accompanying drawings, in which exemplary embodiments of the invention are shown.

Figure 1:
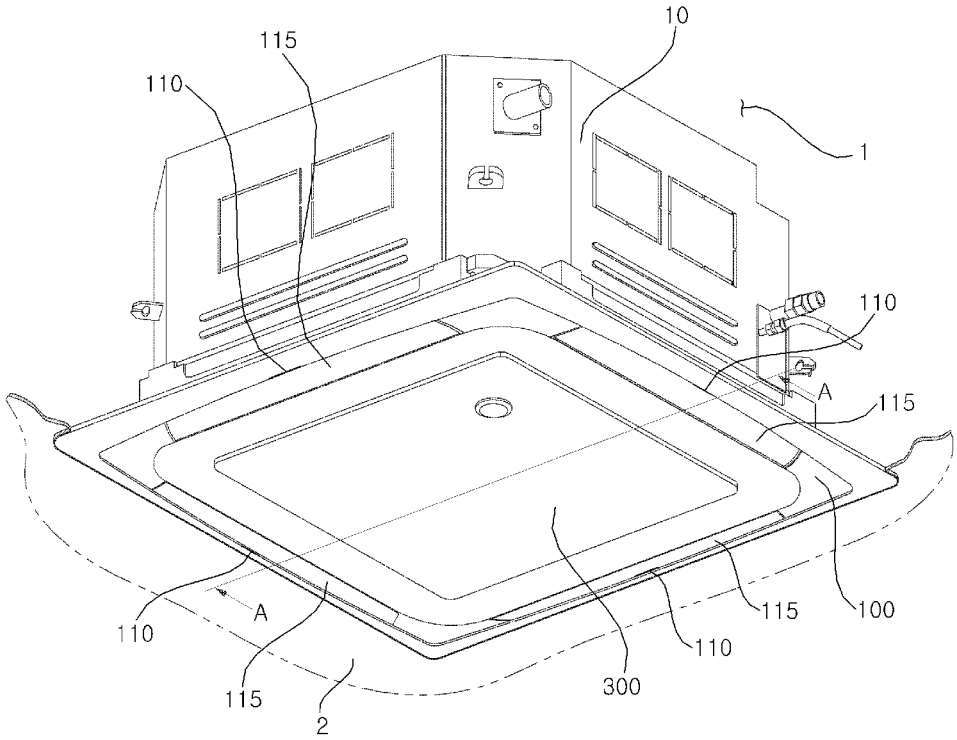
FIG. 1 illustrates a perspective view of a ceiling-mounted air conditioner according to an exemplary embodiment of the present invention.
Figure 2:
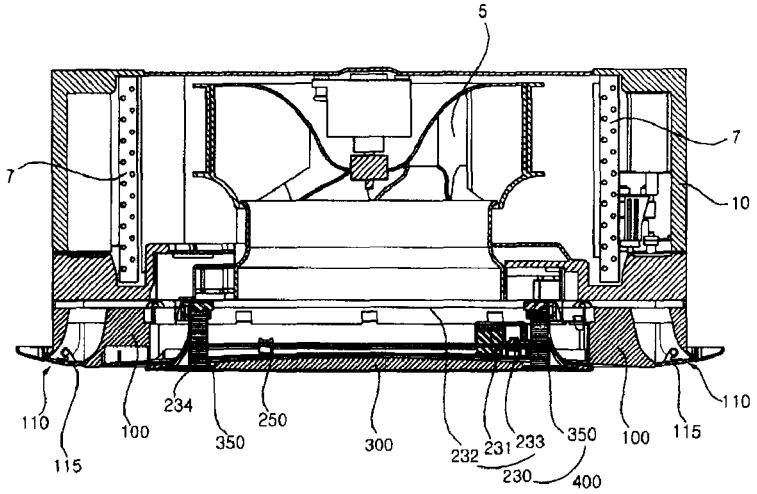
FIGS. 2A and 2B illustrate cross-sectional views taken along line A-A of FIG. 1.
Figure 2:
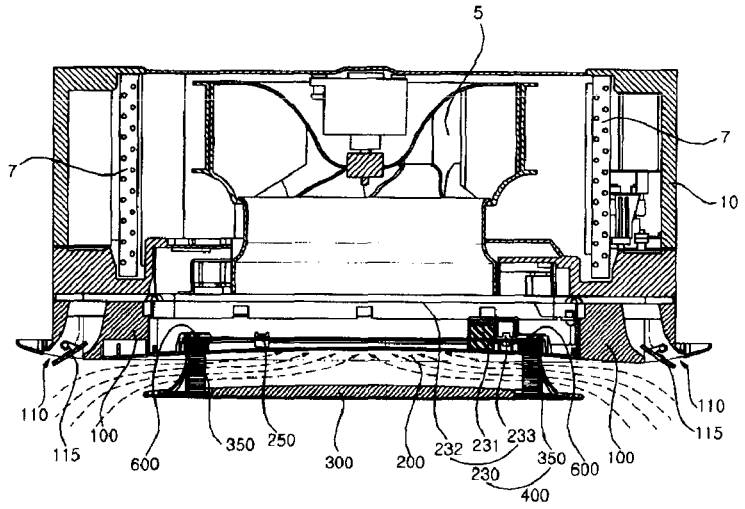
Figure 3:
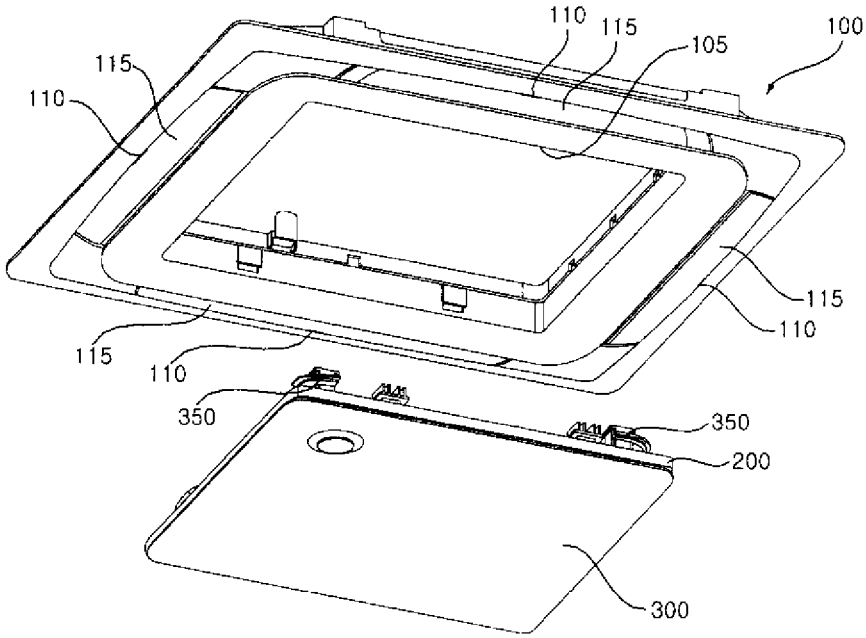
FIG. 3 illustrates an exploded perspective view of an outlet panel, an intake panel and a door panel shown in FIG. 1.
Figure 4:
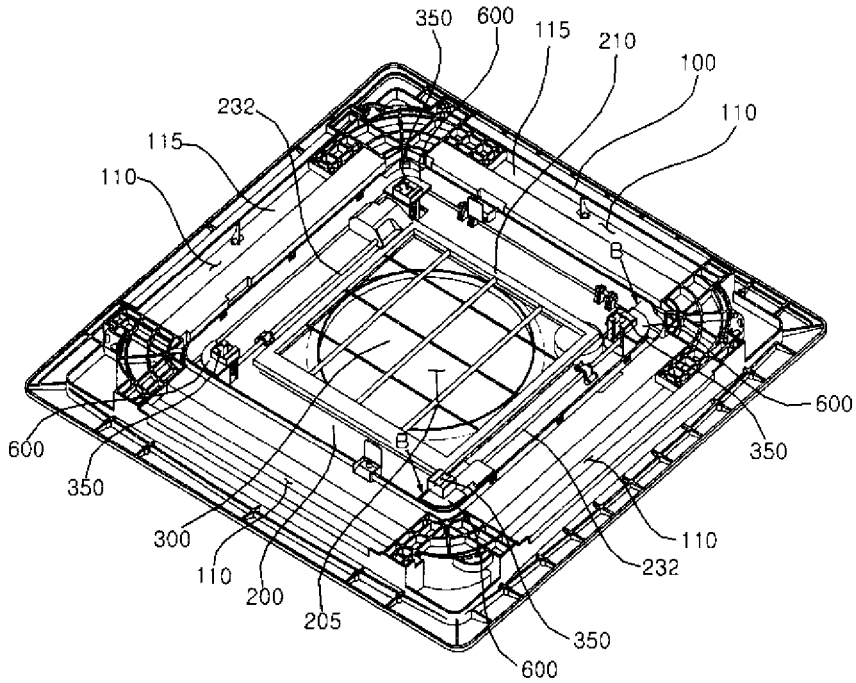
FIG. 4 illustrates a perspective view of the outlet panel, the intake panel and the door panel shown in FIG. 1.
Figure 5:
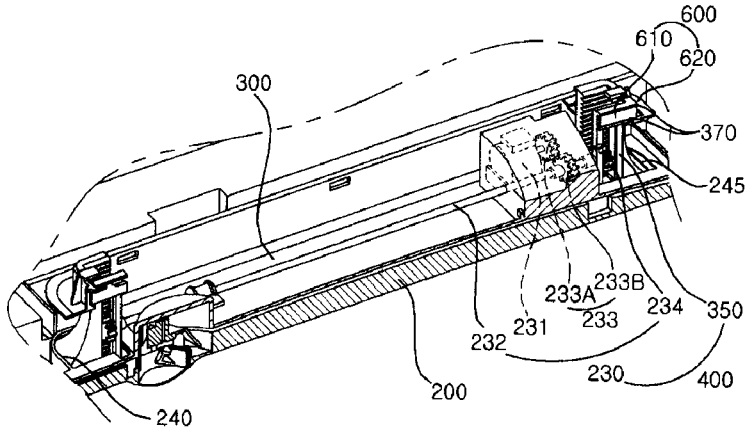
FIGS. 5A and 5B illustrate exploded perspective views taken along line B-B of FIG. 3.
Figure 5:
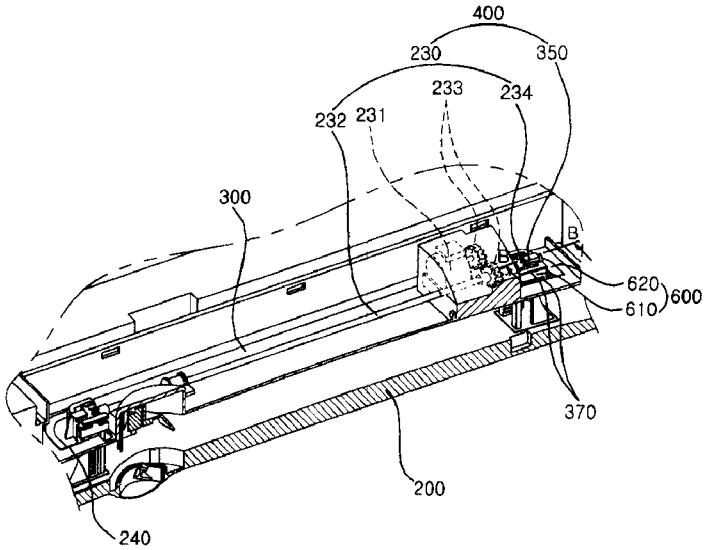
Figure 6:
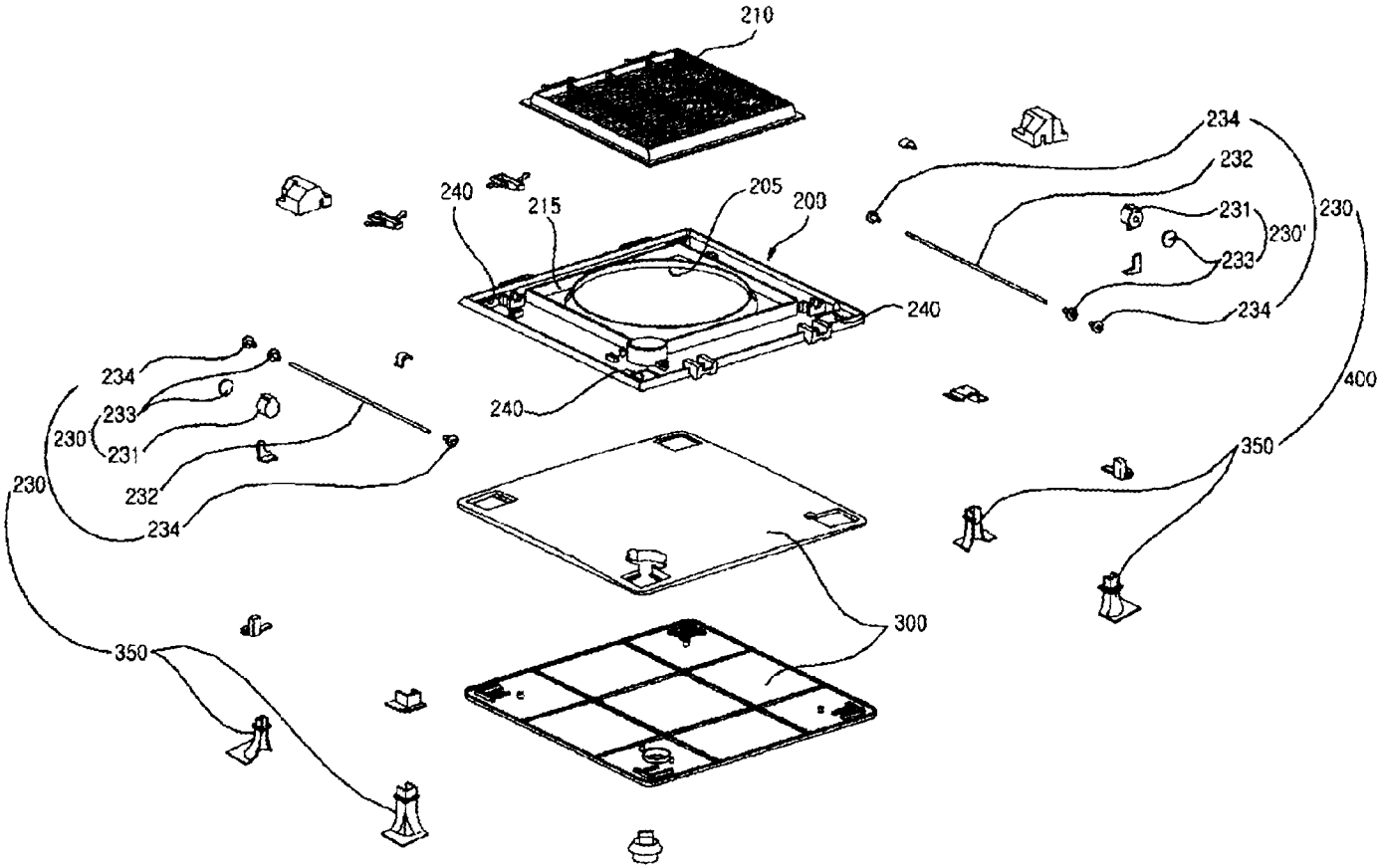
FIG. 6 illustrates an exploded perspective view of the door panel shown in FIG. 3.

FIG. 1 illustrates a perspective view of a ceiling-mounted air conditioner according to an exemplary embodiment of the present invention, FIGS. 2A and 2B illustrate cross-sectional views taken along line A-A of FIG. 1, FIG. 3 illustrates an exploded perspective view of an outlet panel 100, an intake panel 200 and a door panel 300 shown in FIG. 1, FIG. 4 illustrates a perspective view of the outlet panel 100, the intake panel 200 and the door panel 300, FIGS. 5A and 5B illustrate exploded perspective views taken along line B-B of FIG. 3, and FIG. 6 illustrates an exploded perspective view of the door panel 300.

Referring to FIGS. 1 and 2, the ceiling-mounted air conditioner may include a main body 10 disposed between a ceiling 1 and a ceiling finishing material 2.

The main body 10 may have an open bottom. Thus, an air blower 5, which draws indoor air into the main body 10 and discharges the air, a heat exchanger 7, which exchanges heat with the indoor air, may be installed in the main body 10.

More specifically, the main body 10 may be formed as a square or rectangular box having an open bottom, and may thus be able to accommodate the air blower 5 and the heat exchanger 7 therein.

An outlet panel 100 may be installed at the bottom of the main body 10, and may be on a level with the ceiling finishing material 2. The outlet panel 100 may hide the bottom of the main body 10 from view. The outlet panel 100 may have an opening 105 in the middle, and may thus accommodate an intake panel 200 therein. The outlet panel 100 may include a plurality of air outlets 110 which are formed along the boundaries of the outlet panel 100 and discharge air processed in the main body 10.

The outlet panel 100 may be formed as a rectangular or square frame, conforming to the shape of the bottom of the main body 10, and may thus be able to effectively hide the bottom of the main body 10 from view.

A plurality of wind vanes 115 may be installed in their respective air outlets 110. The wind vanes 115 may open or shut their respective air outlets 110 by rotating by a predetermined angle, and may adjust the direction of flow of air discharged from the air outlets 110.

Referring to FIGS. 3 through 6, the ceiling-mounted air conditioner may also include the intake panel 200, which is installed inside the outlet panel 100 so as to shut the opening 105 of the outlet panel 100.

The intake panel 200 may have an air intake 205 in the middle, and may thus allow indoor air to be drawn into the main body 10. A purification filter 210 may be disposed above the air intake 205 and may filter out impurities in the air drawn into the main body 10. A purification filter installation unit 215 may be formed on the top surface of the intake panel 200 so as for the purification filter 210 to be installed on the intake panel 200.

The air intake 205 of the intake panel 200 may be formed as a circle and may thus allow indoor air to be drawn into the center of the main body 10. The intake panel 200 may not only provide room for the installation of the purification filter 210, but also serve as an orifice for adjusting the amount and speed of air drawn into the main body 10.

However, the air intake 205 may not necessarily have to be formed as a circle. That is, the air intake 205 may be formed in various shapes other than a circular shape.

Referring to FIGS. 1 through 3, the ceiling-mounted air conditioner may also include the door panel 300, which is disposed below the intake panel 200 and opens or closes the air intake 205 of the intake panel 200 by being lifted up and down.

The size of the door panel 300 may correspond to the size of the intake panel 200. More specifically, the size of the door panel 300 may be greater than the size of the intake panel 200. In this case, when the door panel 300 is lifted and thus shuts the intake panel 200, the intake panel 200 can be hidden from view.

The opening 105 may be formed as a rectangle or a square. The intake panel 200 may conform to the shape of the opening 105. That is, the intake panel 200 may also be formed as a rectangle or a square.

Referring to FIGS. 1 and 3, the ceiling-mounted air conditioner may also include a plurality of elevation driving units 230 which are disposed on the top surface of the intake panel 200 and apply driving force to the door panel 300 so as for the door panel 300 to be lifted up or down.

More specifically, the elevation driving units 230 may be a predetermined distance apart from each other. In this exemplary embodiment, two elevation driving units 230 may be disposed on and extend either vertically or horizontally along a pair of opposite sides of the intake panel 200.

Each of the elevation driving units 230 may include a motor 231, which is disposed on the intake panel 200, a shaft 232, which is arranged in line with the rotation axis of the motor 231, a connecting element 233 which connects the motor 231 and the shaft 232 and thus allows the shaft 232 to rotate along with the motor 231, and a plurality of rotation elements 234, which are installed at either end of the shaft 232 and can rotate the shaft 232.

Referring to FIG. 6, two motors 231 may be disposed on a pair of opposite sides of the intake panel 200. Two shafts 232 may be disposed on the opposite sides of the intake panel 200 where the two motors 231 are disposed, and may be isolated from each other.

For convenience, the motors 231 and their respective connecting elements 233 will hereinafter be collectively referred to as shaft driving units 230'.

It is important to precisely control the motors 231 because the rotation speed of the motors 231 affects the elevation of the door panel 300. That is, if the motors 231 have different rotation speeds, the door panel 300 may not be able to be uniformly elevated, and may thus adversely affect the exterior appearance of the ceiling-mounted air conditioner.

Each of the connecting elements 233 may include a motor gear 233A, which is connected to the rotation axis of a corresponding motor 231, and a shaft gear 233B, which engages with the motor gear 233A and rotates a corresponding shaft 232 by rotating along with the motor gear 233A.

When turned on with the use of, for example, a remote control, the motors 231 may rotate. As a result, the connecting elements 233 may rotate, and the shafts 232 may rotate about their rotation axes. Then, the rotation elements 234 may rotate accordingly.

The door panel 300 may be able to be lifted up or down and thus to open or shut the air intake 205 of the intake panel 200.

More specifically, referring to FIGS. 5A and 5B, when lifted up, the door panel 300 may be placed in contact with the bottom of the intake panel 200. On the other hand, when lifted down, the door panel 300 may open the air intake 205 of the intake panel 200, and may thus guide indoor air into the main body 10 through the air intake 205.

Referring to FIG. 5B, the ceiling-mounted air conditioner may also include a plurality of moving elements 350, which are installed on the door panel 300. The moving elements 350 extend vertically, and may be lifted up or down in accordance with the rotation of the rotation elements 234.

The moving elements 350 may be coupled onto the top surface of the door panel 300, and may lift up or down the door panel 300.

Given that the moving elements 350 are used along with the elevation driving units 230 to lift up or down the door panel 300, the moving elements 350 and the elevation driving units 230 (including a motor 231, a shaft 232, a connecting element 233 and a plurality of rotation elements 234) will hereinafter be collectively referred to as an elevation device 400.

The ceiling-mounted air conditioner may also include a plurality of elevation guide holes 240, which are formed through the intake panel 200 so that the moving elements 350 can be lifted up or down through the elevation guide holes 240.

The rotation elements 234 may be pinion gears, which rotate about the axes of their respective shafts 232.

Figure 7:
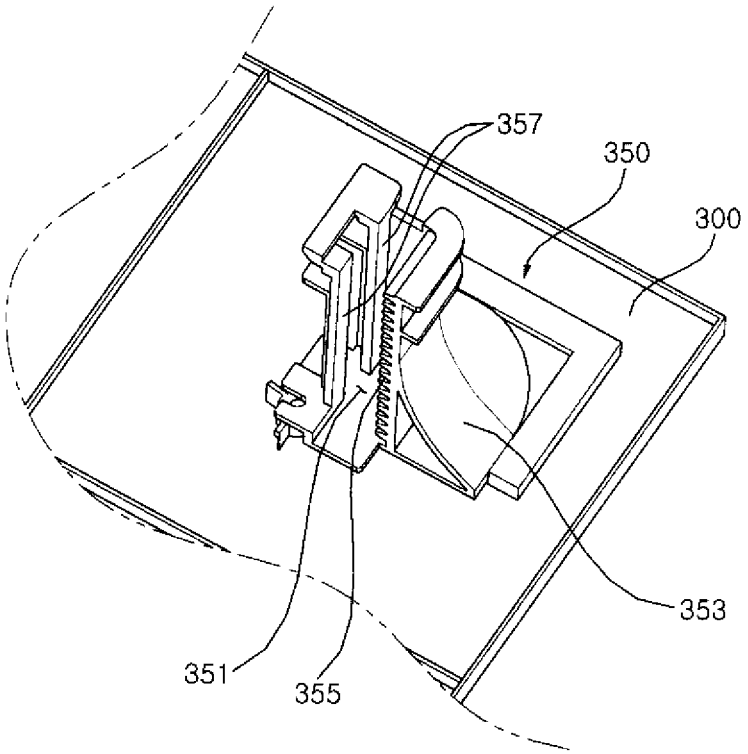
FIG. 7 illustrates a perspective view of an example of a moving element shown in FIG. 6.
Figure 8:
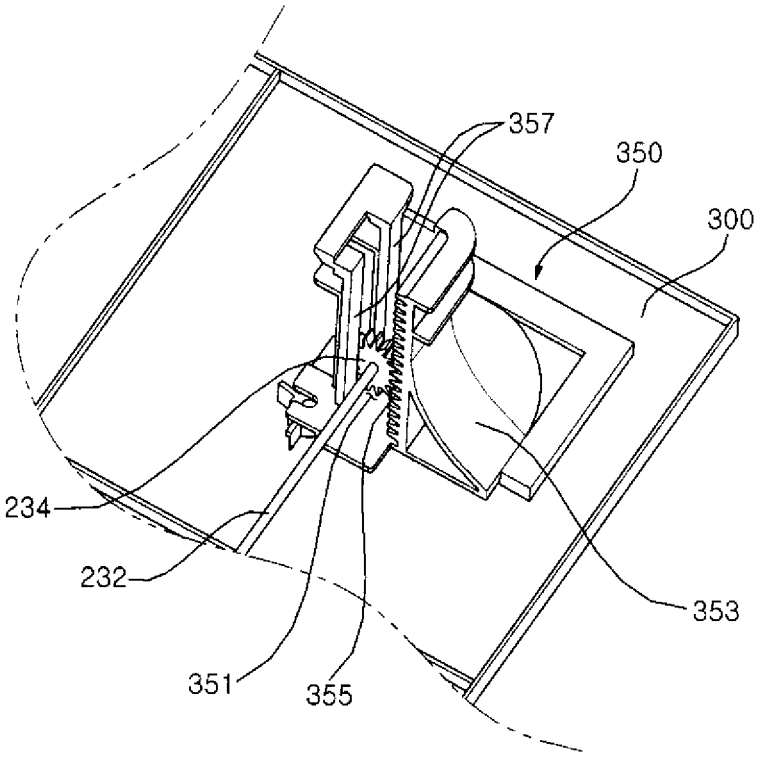
FIG. 8 illustrates a perspective view of the coupling between a rotation element and the moving element shown in FIG. 7.
Figure 9:
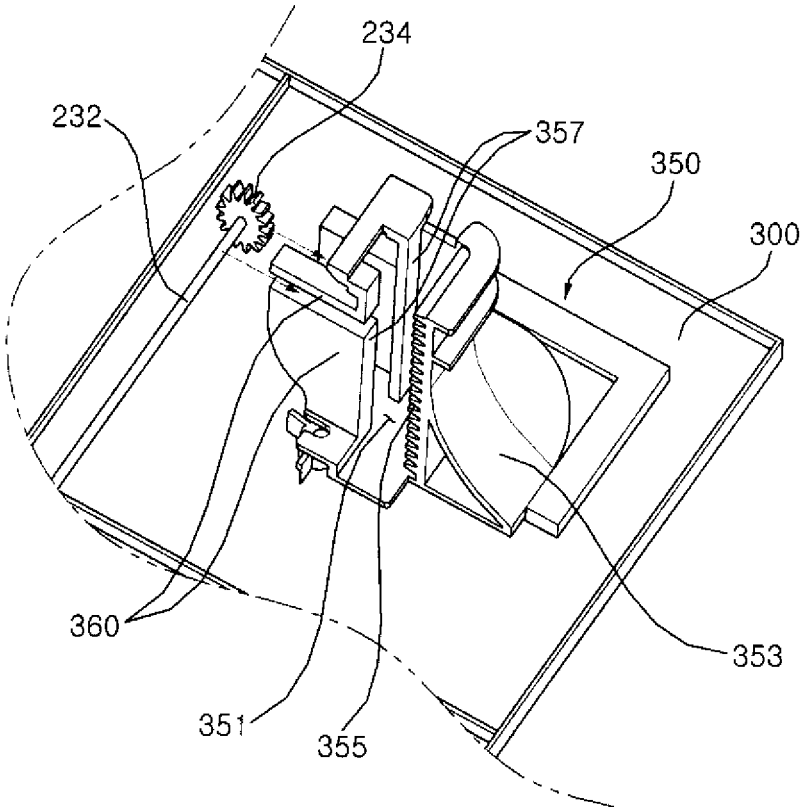
FIG. 9 illustrates a perspective view of another example of the moving element shown in FIG. 6.
Figure 10:
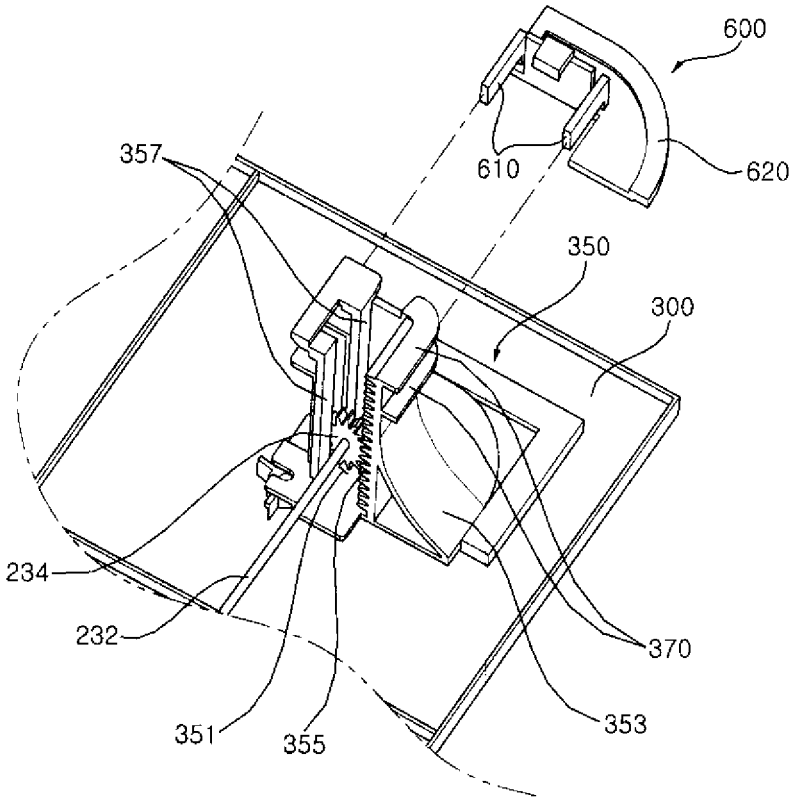
FIG. 10 illustrates an exploded perspective view of the coupling between the moving element shown in FIG. 7, a shaft and a stopper.
Figure 11:
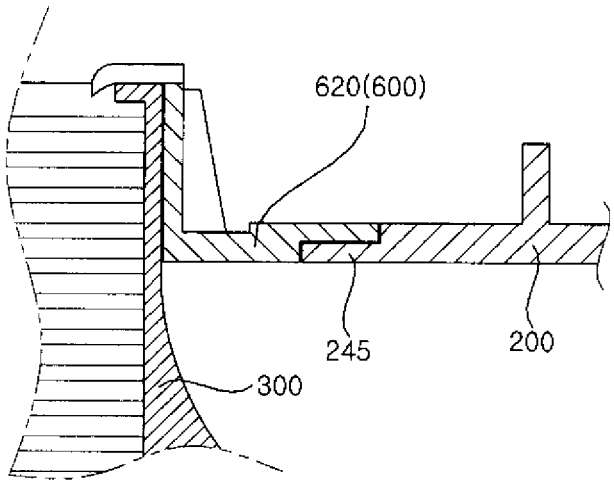
FIG. 11 illustrates a cross-sectional view taken along line B-B of FIG. 5B.

FIG. 7 illustrates a perspective view of an embodiment of the moving elements 350 shown in FIG. 6, FIG. 8 illustrates a perspective view showing how a rotation element 234 is installed in the moving element 350 shown in FIG. 7, FIG. 9 illustrates a perspective view of another embodiment of a moving element 350 shown in FIG. 6, FIG. 10 illustrates an exploded perspective view showing how a shaft 232 and a stopper 600 are coupled to the moving element 350 shown in FIG. 7, and FIG. 11 illustrates a cross-sectional view taken along line B-B of FIG. 5B.

Referring to FIGS. 7 and 8, the moving element 350 may include a cavity portion 352, which extends vertically inside the moving element 350, a vertical portion 353, which protrudes vertically beyond the top surface of the door panel 300, a driving force transmitting portion 355, which is formed on one side of the cavity portion 352 and contacts a rotation element 234, and an elevation guide portion 357, which is formed on the other side of the cavity portion 351 and guides the elevation of the vertical portion 353.

The driving force transmitting portion 355 may contact the rotation element 234. If the rotation element 234 includes a pinion gear, the driving force transmitting portion 355 may include a rack gear which is formed on one side of the cavity portion 351 and extends vertically along the cavity portion 351, and may thus be able to engage with the rotation element 234.

When the rotation element 234 rotates while engaging with the driving force transmitting portion 355 inside the cavity portion 351, the moving element 350 may be lifted up or down against the rotation element 234. In order to allow the rotation element 234 to smoothly rotate inside the cavity portion 351, the whole rotation element 234 except for a portion where teeth for engaging with the driving force transmitting portion 355 may need not to be interfered with by any structure inside the cavity portion 351.

The elevation guide portion 357 may have a cutout formed on one side thereof along a vertical direction. Thus, a portion of the rotation element 234 where no teeth is formed can be inserted into the elevation guide portion 357.

In short, the rotation element 234 may be inserted into the cavity portion 351, and may rotate inside the cavity portion 351 while engaging with the driving force transmitting portion 355. As a result, the moving element 350 may be lifted up or down upon the rotation of the rotation element 234. If the moving element 350 is elevated, the door panel coupled to the moving element 350 may also be elevated and may thus shut the air intake 205 of the intake panel 200.

When the door panel 300 is lifted down from the intake panel 200 and thus opens the air intake 205 of the intake panel 200, an intake path through which indoor air can be drawn into the main body 10 may be formed between the door panel 300 and the intake panel 200.

Since the moving element 350 is disposed on the intake path, the flow of indoor air may be interfered with by the moving element 350. In order to address this problem, the vertical portion 353 may have a curved lateral surface, as shown in FIG. 7.

Referring to FIGS. 7 and 8, the moving element 350 may be disposed at each corner of the door panel 300, and the rotation element 234, which is provided on one end of a shaft 232, may be vertically (particularly, downwardly) inserted into the cavity portion 351 of the moving element 350.

When two rotation elements 234 are provided on either end of the shaft 232 and one of the two rotation elements 234 is inserted into the cavity portion 351 of the moving element 350, the other rotation element 234 may not be properly inserted into its corresponding cavity portion 351.

In order to address this problem, the moving element 350 may also include a rotation element entrance/exit portion 360, as shown in FIG. 9. Referring to FIG. 9, the rotation element entrance/exit portion 360 may be formed at the top of the moving element 350 and may allow the rotation element 234 to be horizontally inserted into the moving element and thus to be properly placed in contact with the driving force transmitting portion 355.

More specifically, referring to FIG. 9, since the rotation element 234 can be horizontally inserted into the moving element 350 through the rotation element entrance/exit portion 360, the rotation element 234 can properly contact and engage with the driving force transmitting portion 355.

The ceiling-mounted air conditioner may also include a stopper 600, which is coupled to the elevation device 400, limits a downward movement of the door panel 300 and prevents the door panel 300 from falling down.

Referring to FIG. 10, the stopper 600 may be attached to or detached from an upper part of the moving element 350, which protrudes through an elevation guide hole 240.

More specifically, the moving element 350 may protrude beyond the top surface of the door panel 300. When the door panel 300 is lifted up or down against the intake panel 200, the moving element 350 may also be lifted up or down through the elevation guide hole 240. The stopper 600 may be horizontally attached to or detached from the upper part of the moving element 350, which protrudes beyond the intake panel 200.

In short, the stopper 600 can be attached to or detached from the upper part of the moving element 350. Thus, the user can easily detach the stopper 600 and can perform various tasks (such as installing a decorating element onto the door panel 300) on the door panel 300.

A pair of rib portions 370 for allowing the stopper 600 to be horizontally inserted into the upper part of the moving element 350 may be formed at the upper part of the moving element 350. The stopper 600 may include a pair of attachment/detachment portions 610 which can be respectively inserted slidably into the rib portions 370, and a latch portion 629 which engages with the top surface of the intake panel 200.

That is, the stopper 600 may be coupled to the moving element 350 by inserting the attachment/detachment portions 610 into their respective rib portions 370. Then, the stopper 600 can be lifted up or down along with the moving element 350. When the door panel 300 is lifted down, the latch portion 620 may engage with the top surface of the intake panel 200, and may thus limit the distance between the door panel 300 and the intake panel 200.

In order to properly engage with the top surface of the intake panel 200, the latch portion 620 may extend horizontally from the attachment/detachment portions 610, and the size of the latch portion 620 may be greater than the size of the elevation guide hole 240.

Since the elevation guide hole 240 is directly connected to the inside of the main body 10, indoor air may be drawn into the main body 10 not only through the air intake 205 but also through the elevation guide hole 240.

More specifically, when the ceiling-mounted air conditioner begins to operate, the door panel 300 may be lifted down and may thus open the air intake 205 of the intake panel 200. In this case, in order to prevent indoor air from being drawn into the main body 10 through the elevation guide hole 240 without being purified by the purification filter 210, the latch portion 620 of the stopper 600 may be lifted down along with the door panel 300 and may thus shut the elevation guide hole 240.

Referring to FIG. 11, a holding portion 245 may be formed with a step difference on the top surface of the intake panel 200, and may engage with the bottom of the latch portion 620. When the latch portion 620 is held by and engages with the holding portion 245, the elevation guide hole 240 can be properly sealed, and thus, drops of dew collected inside the main body 10 can be prevented from leaking from the elevation guide hole 240.

The moving element 350 may be formed at each corner of the door panel 300. Thus, it is possible to properly distribute the load of the door panel 300 during the elevation of the door panel 300. In addition, since the latch portion 620 of the stopper 600 engages with the intake panel 200 at each corner of the intake panel 200, it is possible to prevent the door panel 300 from being accidentally detached from the intake panel 200.

The operation of the ceiling-mounted air conditioner will hereinafter be described in detail.

When the ceiling-mounted air conditioner is turned on with the use of, for example, a remote control, and thus a predetermined signal is applied to a controller (not shown) of the ceiling-mounted air conditioner, the controller may operate the air blower 5 and the heat exchanger 7 in harmony with each other, and may rotate the motors 231 in a first direction.

Then, the connecting element 233 may be rotated, thereby rotating the shafts 232 and the rotation elements 234.

The rotation elements 234 may engage with their respective driving force transmitting portions 355. Thus, referring to FIG. 2(*b*), when the rotation elements 234 rotate, the moving elements 350 may be lifted down against the rotation elements 234.

In this case, since the rotation elements 234 are partially inserted into the elevation guide holes 357, the vertical portions 353 of the moving elements 350 can be stably lifted down by being guided by the elevation guide portions 357 of the moving elements 350.

In addition, when the vertical portions 353 of the moving elements 350 are lifted down, the stopper 600 may be safely held by the holding portion 245 formed around each of the elevation guide holes 240 on the intake panel 200 and may thus limit the distance between the door panel 300 and the intake panel 200 and shut the elevation guide holes 240.

When the ceiling-mounted air conditioner is turned off with the use of the remote control and thus a predetermined signal is applied to the controller, the controller 180 may stop operating the air blower 5 and the heat exchanger 7, and may rotate the motors 231 in a second direction, which is opposite to the first direction.

Then, referring to FIG. 2(*a*), the connecting element 233 and the shafts 232 may be rotated in the second direction. As a result, the rotation elements 234 may be lifted up, and thus, the door panel 300 may shut the air intake 205 by being placed in contact with the bottom of the intake panel 200. In this case, the stopper 600 may be lifted up along with the door panel 300. Since the air intake 205 of the intake panel 200 is shut by the door panel 300, the exterior of the ceiling-mounted air conditioner may be improved. While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A ceiling-mounted air conditioner comprising:

a main body which is fixed onto a ceiling of a room where the ceiling-mounted air conditioner is installed;

an intake panel which is disposed at the bottom of the main body and has an air intake;

a door panel which is disposed at the bottom of the intake panel and shuts or opens the air intake by being lifted up or down;

a plurality of moving elements which are installed onto the top surface of the door panel, and are lifted up or down so as to be able to lift up or down the door panel; and a plurality of rotation elements comprising pinions which are disposed at the intake panel and thus lift up or down the moving elements, wherein each of the moving elements includes a vertical portion having a cavity portion extending vertically therein and protruding from the top surface of the door panel, wherein the vertical portion includes a driving force transmitting portion disposed on one side of the cavity portion and contacting a corresponding rotation element, and an elevation guide portion disposed on the other side of the cavity portion, corresponding to the driving force transmitting portion, formed by forming a vertical cutout on the other side of the cavity portion so that part of the corresponding rotation element can be inserted into the vertical cutout and guide the elevation of the vertical portion.

2. The ceiling-mounted air conditioner of claim 1, wherein each of the rotation elements includes a pinion gear and the driving force transmitting portion includes a rack gear engaging with the pinion gear.

3. The ceiling-mounted air conditioner of any one of claims 1 through 2, wherein the vertical portion has a curved lateral surface.

4. The ceiling-mounted air conditioner of claim 1, wherein each of the moving elements further includes a rotation element entrance/exit portion which is formed horizontally so that the corresponding rotation element can be inserted thereinto and placed in contact with the driving force transmitting portion.

5. The ceiling-mounted air conditioner of claim 1, further comprising a plurality of stoppers attached to or detached from their respective moving elements, limiting a downward movement of the door panel.

6. The ceiling-mounted air conditioner of claim 5, wherein the intake panel includes a plurality of elevation guide holes formed at regular intervals and the moving elements are lifted up or down through the elevation guide holes.

7. The ceiling-mounted air conditioner of claim 6, wherein the stoppers are attached to or detached from upper parts of the moving elements that protrude beyond the elevation guide holes.

8. The ceiling-mounted air conditioner of claim 7, wherein each of the moving elements further includes a pair of rib portions formed at the upper part thereof, and each of the stoppers can be slidably inserted between the rib portions, and includes a pair of attachment/detachment portions horizontally inserted slidably into the rib portions and a latch portion which engages with the top surface of the intake panel.

9. The ceiling-mounted air conditioner of claim 8, wherein the latch portion extends horizontally from the attachment/detachment portions so as to be able to stop a corresponding moving element at the top surface of the intake panel.

10. The ceiling-mounted air conditioner of claim 8, wherein the intake panel further includes a holding portion which is formed with a step difference around each of the elevation guide holes and can safely hold the bottom of the latch portion thereon.

11. The ceiling-mounted air conditioner of claim 10, wherein the stoppers have a greater size than the elevation guide holes so as to be able to shut the elevation guide holes and to be safely held by the holding portion.

* * * * *